United States Patent [19]

Gregg, Jr.

[11] Patent Number: 4,731,189

[45] Date of Patent: Mar. 15, 1988

[54] BULLET LUBRICANT AND METHOD OF COMPOUNDING SAID LUBRICANT

[76] Inventor: George L. Gregg, Jr., 25606—14th Pl. S., Kent, Wash. 98032

[21] Appl. No.: 912,413

[22] Filed: Sep. 29, 1986

[51] Int. Cl.[4] ..... C10M 125/02; C10M 125/22

[52] U.S. Cl. ..... 252/23; 252/18; 252/22

[58] Field of Search ..... 252/18, 22, 23

[56] References Cited

U.S. PATENT DOCUMENTS

| | | | |
|---|---|---|---|
| 1,953,904 | 4/1934 | Bowyer et al. | 102/12 |
| 2,244,705 | 6/1941 | Hutchinson et al. | 252/46 |
| 2,346,124 | 4/1944 | Dew | 252/49.5 |
| 2,560,051 | 7/1951 | Brown | 252/22 |
| 3,015,623 | 1/1962 | Loring et al. | 252/18 |
| 3,097,169 | 7/1963 | Hall | 252/23 |
| 3,170,878 | 2/1965 | Armstrong | 252/18 |
| 3,877,374 | 4/1975 | Cook | 102/38 |
| 3,933,657 | 1/1976 | Seni et al. | 252/29 |
| 4,098,193 | 7/1978 | Schroeder | 102/92 |
| 4,196,670 | 4/1980 | Vatsvog | 102/92.2 |
| 4,334,477 | 6/1982 | Axelrod et al. | 102/435 |
| 4,363,737 | 12/1982 | Rodriguez | 252/19 |
| 4,454,175 | 6/1984 | Martin | 427/242 |
| 4,465,883 | 8/1984 | Lopata | 585/9 |

*Primary Examiner*—William R. Dixon, Jr.
*Assistant Examiner*—Ellen McAvoy
*Attorney, Agent, or Firm*—Harry M. Cross, Jr.

[57] ABSTRACT

A composition for bullet lubrication which comprises an admixture of petroleum and silicone oil metallic soap greases, molybdenum disulfide, graphite, and beeswax.

8 Claims, No Drawings

BULLET LUBRICANT AND METHOD OF COMPOUNDING SAID LUBRICANT

BACKGROUND OF THE INVENTION

Field of the Invention

The present invention relates to lubricants and, more particularly, to lubricating compositions especially adapted for use in conjunction with projectiles and firearms and methods of compounding such lubricants.

One of the more important problems with unjacketed bullets is known as "leading", which is the phenomenon of lead from the bullet being deposited, by melting or otherwise, on the interior surfaces of the gun barrel. When this occurs, it is difficult to fire the bullets accurately and consistently even with exactly matched loads in a firearm even from a fixed position. In an attempt to overcome the detrimental effects of leading, commercial ammunition manufacturers and individual hand loaders have adopted various expedients. One of these consists of jacketing the lead bullet with gilding metal, a copper base alloy nominally containing 5 percent zinc. Unfortunately, while the jacketed bullet is a significant advance in the art, it too has disadvantages, the more important of which include the expensiveness and "copper fouling"; i.e., the transference of copper from the bullet to the inner surface of the barrel. Recently aluminum jacketed bullets have been introduced for pistol and revolvers to solve the leading problem at reduced cost and yet allow suitable upset upon impact. Yet, this round is not suitable for rifles where bullet velocities are high enough to cause aluminum fouling.

It becomes apparent that the foregoing improvements have not been complete answers to all of the problems betsetting the marksman. Indeed, the proposed solutions to many of the problems have not only frequently raised difficult new problems but also have served to emphasize the problems remaining unsolved. For example, friction was once considered to be such a small factor of ballistics that it was often ignored. Now, the opposite is true particularly since it is known that even a relatively low velocity can create sufficient frictional heat to actually melt the surface of a lead bullet and cause leading in the barrel and lead gases can be produced. Furthermore, gun barrel imperfections even though microscopic in size can cause small particles of metal jackets, zinc bases or lead to become embedded in the surface of the barrel. Continued firing only creates additional deposits which can shift positions within the barrels resulting in erratic trajectories.

Efforts to counteract frictional forces with most prior art wax lubricants have not been too successful particularly where the lubricant selected is a candle wax or one that has been employed to combat frictional effects in a non-ballistics application. A probable reason for the failure of such a wax lubricant may be traceable to the sometimes severe condrtions encountered in shooting a firearm where bullet velocities may be as high as 3,000 or 4,000 feet per second and where pressures on the bullet may be as high as 50,000 pounds per square inch. In addition, many of the prior art wax lubricants, including those intended for ballistics applications, are unstable at the frictional temperatures and pressures encountered by a bullet rapidly traveling through a gun barrel. Furthermore, the prior art greased wax compounds are tacky and thus tend to pick up grit and sand particles which can contribute to, rather than inhibit, barrel wear. Some of the other prior art wax lubricants suffer from the disadvantage of being too costly or too difficult to apply to either the firearm or the ammunition.

The whole broad problem of providing a suitable wax lubricant for ballistics applications is rendered even more difficult by the necessity that the lubricant possess a formidable array of anomalous characteristics. For example, it should be noncorrosive to both surfaces it is to lubricate. It should remain stable over the entire temperature range encountered in ballistic applications. It should be fairly inexpensive. It should have the capacity to tenaciously fill any pores in the barrel and yet provide a fairly smooth surface.

In addition to the ballistic considerations above there are production considerations. As noted above, it is a common practice in loading bullets into shell cases to coat each bullet, prior to loading, with a lubricant to reduce the "leading effect" of the bullet on the bore of the firearm through which the bullet is projected. The most commonly used lubricant is beeswax which presents a problem in that residue of the beeswax slowly builds up on the loading mechanism of automatic equipment used to load the bullets into the shell cases. This residue eventually clogs the mechanism for the purpose of disassembling the loading equipment for cleaning. It has remained a problem to find suitable compositions for cleaning. It has remained a problem to find suitable composition for coating bullets without at the same time creating problems in use of automated loading equipment.

In addition to the above concerns there is the more recent recognition that improperly ventilated indoor ranges can develop sufficient levels of lead gases under intensive shooting conditions to be a possible health hazard unless the bullets are coated or jacketed.

Yet, those precise ranges have a maximum need for inexpensive target ammunition so any such coating or jacket should be cheap to make so that ranges can shoot a maximum number of rounds within a given ammunition budget without health hazards.

SUMMARY OF THE INVENTION

The lubricant of the present invention is a modified wax lubricant comprising a combination of petroleum and silicone oil metallic soap greases, beeswax and graphite and molybdenum disulfide. In compounding the lubricant the greases and molybdenum disulfide are mixed and heated at an elevated temperature for a period of time. Then, the temperature is lowered and beeswax and graphite are added and blended at the lower temperature for a period of time.

The resulting lubricant composition yields superior results. Firing bullets coated with this composition results in lowered gun barrel temperatures, tighter and consistent target patterns, and little or no gun barrel fouling. Moreover, the anti-fouling characteristics of the composition result in the cleaning of the gun firing mechanism. Also, when coating bullets with the composition in automatic or semi-automatic bullet lubrication-application machinery, the machinery is cleaned and kept clean during operation. No other beeswax-containing bullet lubricant is known to be so characterized.

DETAILED DESCRIPTION OF PREFERRED EMBODIMENTS

The composition may be formulated from basic ingredients such as molybdenum disulfide powder, mineral oil, silicone oil such as phenyl-methyl-silicone oil, and metallic soap grease such as lithium soap grease. Alternately, it may be formulated from commercially-available blended grease and paste lubricating products. In the latter category MOLYKOTE BR-2 PLUS, (a molybdenum disulfide-containing mineral oil-lithium soap base grease), MOLYKOTE 44 (a silicone oil thickened with lithium soap), and MOLYKOTE G-n (a molybdenum disulfide-containing mineral oil base paste) manufactured by Dow Corning of Midland, Mich., U.S.A. are suitable. To these, finely divided molybdenum disulfide powder, such as MOLYKOTE Z powder from Dow Corning, may be included. The preferred combination of the above ingredients is (by weight per cent): 9–16% molybdenum disulfide; 13–20% mineral oil; 17–25% silicone oil; and 39–52% metallic soap grease. This initial composition is then preferably blended with 5–28% beeswax and 7–42% microfine graphite. The total amount of molybdenum disulfide present in the initial composition should be greater than about 5% and less than about 24%. The total amount of mineral oil present in the initial composition should be greater than about 10% and less than about 32%. The total amount of silicone oil present in the initial composition should be greater than about 13% and less than about 31%. The total amount of metallic soap grease present in the initial composition should be greater than about 34% and less than about 61%.

Table I lists examples of initial composition variations, in weight per cent, that are satisfactory. Example E is particularly outstanding and far superior to any bullet lubricant known to the inventor. These examples were formulated using the MOLYKOTE brand products previously identified.

| Ingredient | A | B | C | D | E | F | G | H | I |
|---|---|---|---|---|---|---|---|---|---|
| Molybdenum Disulfide | 5 | 24 | 13 | 10 | 12 | 14 | 11 | 16 | 9 |
| Mineral Oil | 18 | 14 | 10 | 32 | 16 | 18 | 12 | 20 | 14 |
| Phenol Methyl Silicone | 25 | 20 | 25 | 14 | 23 | 13 | 31 | 30 | 17 |
| Lithium Soap Grease | 52 | 42 | 52 | 39 | 49 | 55 | 44 | 34 | 61 |

Table II lists examples of final composition variations, in weight percent, that are satisfactory. These examples include, as representative, Example E from Table I as the "Lubricating composition". Table III converts the Table II data to volume percent to illustrate the substantial portion of beeswax in the final composition. That such a high-proportioned beeswax-containing lubricant possesses such outstanding anti-fouling characteristics is in marked contrast to the general trend in thinking concerning bullet lubricants. This general trend identifies beeswax as an undesirable ingredient because of residue build-up. Us of bullets coated with the final composition herein, however, cleans residue-fouled coating machinery, firing mechanisms and gun barrels, and results in reducing gun barrel temperatures in barrels overheated by firing uncoated bullets.

TABLE II

| Ingredient | J | K | L | M | N | O | P |
|---|---|---|---|---|---|---|---|
| Lubricating Composition | 3 | 16 | 56 | 13 | 7 | 18 | 12 |
| Beeswax | 75 | 65 | 34 | 50 | 85 | 74 | 50 |

TABLE II-continued

| Ingredient | J | K | L | M | N | O | P |
|---|---|---|---|---|---|---|---|
| Graphite | 22 | 19 | 10 | 27 | 8 | 8 | 38 |

TABLE III

| Ingredient | J | K | L | M | N | O | P |
|---|---|---|---|---|---|---|---|
| Lubricating Composition | 3 | 7 | 40 | 21 | 13 | 15 | 16 |
| Beeswax | 89 | 78 | 55 | 69 | 79 | 77 | 81 |
| Graphite | 8 | 15 | 5 | 10 | 7 | 8 | 3 |

The ingredient making up the initial composition (such as those identified in Table I) are heated to 350° F. to 400° F. for several minutes while being stirred continuously. A preferred heating period is about 5 minutes. The temperature is then reduced to 150° F. to 350° F. and beeswax and microfine graphite are added. Thisfinal composition is blended for a short period, preferably about 2 minutes and then allowed to cool. The initial composition must be cooked as specified above before addition of the beeswax to yield a satisfactory final composition having the desired characteristics described.

For some uses carnuba wax may be added, along with beeswax, in compounding the final composition. The addition of carnuba wax will harden a bullet coating and may be desirable for some applications. On a volume basis, up to 25% carnuba wax may be added to the final composition. More than 25% volume addition results in cracking of the applied bullet coating. A preferred range would be 10–20 volume %.

I claim:

1. A bullet lubricating composition which comprises an admixture of petroleum and silicone oil metallic soap greases and molybdenum disulfide combined with graphite and a wax base consisting essentially of beesax wherein within the admixture molybdenum disulfide is present in an amount of more than about 5 wt. % and less than about 24 wt. %, mineral oil is present in an amount of more than about 10wt. % and less than about 32 wt. %, silicone oil is present in an amount more than about 13 wt. % and less than about 31 wt. %, and metallic soap grease is present in an amount more than about 34 wt. % and less than about 61 wt. %; and wherein on a volumetric basis beewax is present in an amount between about 55% and 89% of the total composition.

2. The composition of claim 1 wherein within the admixture molybdenum disulfide is present in an amount between 9–16 wt. %; mineral oil is present in an amount between 31–20 wt. %; silicone oil is present in an amount between 17–25 wt. %; and metallic soap grease is present in an amount between 39–52 wt. %.

3. The composition of claim 1 wherein the admixture petroleum and silicone oil soap greases and molybdenum disulfide is blended at a temperature of 350° F. –400° F. for several minutes; and wherein the temperature of admixture is reduced to a temperture of 150° F.–350° F. and beeswax and graphite are blended therein while at the reduced temperture for several minutes to produce the final composition.

4. A method of compounding a bullet lubricant comprising blending an admixture of petroleum and silicone oil metalic soap greases and molybdenum disulfice at a temperature of 350° F.–400° F. for several minutes, wherein within the admixture molybdenum disulfide is provided in an amount of more than about 5 wt. % and less than about 24 wt. %, mineral oil is provided in an amount of more than about 10 wt. % and less than about 32 wt. %, silicon oil is present in an amount of more than about 13 wt. % and less than about 31 wt. % and metalic soap grease is provided in an amount more than about 34 wt. % and less than about 61 wt. % to make up the admixture; reducing the temperature of the admixture to 150° F.-350° F.; and then blending graphite and a wax base consisting essentially of beeswax for several minutes into the admixture to produce the final composition wherein on a volumeteric basis beeswax is present in an amount between about 55% and 89% of the total composition.

5. The method of claim 4 wherein molybdenum disulfide is provided between 9-16 wt. %, mineral oil is provided in an amount between 13-20 wt. %, silicone oil is provided in an amount between 17-25 wt. %, and metallic soap grease is provided in an amount between 39-52 wt. % to make up the admixture.

6. The composition of either claim 1 or 2 wherein said metallic soap grease is present in the form of lithium soap grease.

7. The method of either claim 4 or 5 wherein said metallic soap grease is present in the form of lithium soap grease.

8. The composition of either claim 1 or 2 wherein 10-20% carnuba wax, by volume of the total composition, is added to harden the bullet coating when the composition is applied to a bullet.

* * * * *